US006666767B1

(12) United States Patent
Dayan

(10) Patent No.: US 6,666,767 B1
(45) Date of Patent: Dec. 23, 2003

(54) METHOD OF PLAYING A GAME INVOLVING FORMING A MATRIX DISPLAY OF IDENTIFIERS AND COMPARING TO GROUP OF RANDOMLY SELECTED IDENTIFIERS

(76) Inventor: Marcel Dayan, P.O. Box 1943 R., Melbourne VIC (AU), 3001

( * ) Notice: Subject to any disclaimer, the term of this patent is extended or adjusted under 35 U.S.C. 154(b) by 175 days.

(21) Appl. No.: 09/628,560

(22) Filed: Jul. 28, 2000

(30) Foreign Application Priority Data

Jul. 30, 1999 (AU) ..... PQ1932

(51) Int. Cl.[7] ..... G06F 19/00
(52) U.S. Cl. ..... 463/17; 273/269; 463/19
(58) Field of Search ..... 463/16, 17, 18, 463/19; 273/269

(56) References Cited

U.S. PATENT DOCUMENTS 5,232,221 A * 8/1993 Slidikoff et al. ..... 273/139
5,813,911 A * 9/1998 Margolin ..... 463/19
5,871,398 A * 2/1999 Schneier et al. ..... 463/16
5,979,894 A * 11/1999 Alexoff ..... 273/139
6,099,407 A * 8/2000 Parker, Jr. et al. ..... 463/19
6,280,325 B1 * 8/2001 Fisk ..... 463/19

* cited by examiner

*Primary Examiner*—Michael O'Neill
*Assistant Examiner*—Julie Brocketti

(57) ABSTRACT

There is disclosed a method of playing a game. The game is played by a player obtaining from a set of identifiers, at least four elected identifiers, but no more than a maximum number of elected identifiers preset for a given game. The player obtained identifiers are formed into a matrix display. A game controller randomly, and independently elects a group of identifiers from the set of identifiers. The group of identifiers are compared to the matrix display to determine corresponding identifiers in the matrix display before subsequently determining if there are complete identifiers at all intersections along matrix lines. The game controller awards a prize to the player if the number of matrix lines with identifiers at all intersections along matrix lines is one or more.

36 Claims, 7 Drawing Sheets

METHOD OF PLAYING A GAME INVOLVING FORMING A MATRIX DISPLAY OF IDENTIFIERS AND COMPARING TO GROUP OF RANDOMLY SELECTED IDENTIFIERS

FIELD OF THE INVENTION

This invention relates to a method of playing a game and to a hardware configuration therefor.

DESCRIPTION OF RELATED ART

Hitherto, there have been proposed a number of large scale played games such as Keno, Tattslotto and the like. These games often involve the drawing of the winning numbers by a Master of Ceremonies and the drawing of the numbers and the display of the numbers are usually provided on a mass entertainment medium such as television. These games require a user to make a selection of numbers from a set of numbers and the user is awarded a win if their numbers match those drawn by the Master of Ceremonies. The monies generated from game plays of the above type can be controlled by governments and the government can secure a proportion of the winnings for public purposes such as funding of hospitals and other projects.

There is a need to provide another game.

SUMMARY OF THE INVENTION

Therefore, according to first broad aspect of the present invention there may be provided a method of playing a game, the game being played by:

a.) a player obtaining from a set of identifiers, at least four elected identifiers, but no more than a maximum number of elected identifiers preset for a given game;

b.) forming a matrix display from the player obtained identifiers;

c.) a game controller randomly, and independently electing a group of identifiers from said set of identifiers;

d.) comparing the group of identifiers and the matrix display to determine corresponding identifiers in the matrix display;

e.) determining if there are complete identifiers at all intersections along matrix lines; and f.) the game controller awarding a prize to the player if the number of matrix lines with identifiers at all intersections along matrix lines is one or more.

Preferably, the matrix is a square matrix.

Preferably, the player elects at least one identifier and if the player elects fewer identifiers than said maximum number of identifiers, a game controller randomly elects further identifiers so that the maximum number of identifiers are obtained from said set of identifiers.

Preferably, the prize awarded to the player depends on the number of matrix lines which consist of identifiers at all intersections along matrix lines.

Preferably, prizes of greater value are awarded for larger numbers of matrix lines which consist of identifiers at all intersections along matrix lines.

Preferably the prize is calculated against bets for money made by the player and the number of matrix lines which consist of identifiers at all intersections along matrix lines. In one example fixed odds can be used.

In one embodiment a number of identical games are played, and a progressive jackpot prize is provided based on all the games played if the number of matrix lines which consist of identifiers at all intersections of matrix lines equals a maximum number for a given matrix.

Preferably, the progressive jackpot prize is calculated from all the losing players bets from all those number of games where no jackpot has been won. As each game is played, the jackpot bets made on each game are added to the previous jackpot amount from the second part of the game thereby creating a "progressive jackpot" amount. In the event a player wins all or part of a progressive jackpot, the amount won can be deducted from the jackpot amount and the subsequent jackpot bets are added thereto.

Preferably a plurality of different game types are played, and the progressive jackpot is for players of all game types.

Preferably the player makes a monetary bet with a cashier when electing said at least one identifier, and is provided with a game play receipt means identifying the game, the obtained identifiers and the matrix display.

Preferably the receipt means is in the form of a ticket.

Preferably the ticket also identifies the monetary bet made by the player.

Preferably, a player obtains a ticket by marking a mark sense card and supplies that card to the cashier. Desirably the card is read by a mark sensing card reader device.

Preferably the ticket is issued by a ticket selling terminal.

Preferably at the end of game play, winnings are paid out by the player presenting the ticket to a pay-out cashier.

Preferably the ticket is coded with information relating to the game to be played so that on completion of play, the code can be read and the winnings paid-out.

Preferably the coding is machine readable coding and a machine reader is used to read the code and a pay-out made from that reading by a pay-out terminal.

Preferably a Master of Ceremonies is used during game play to announce the identifiers chosen by the game controller to build excitement to game play.

Preferably each of the identifiers chosen by the game controller is displayed on a game monitor screen.

Preferably game play is software controlled in a computer device to which a game monitor screen is connected, and said game controller is functionally controlled by the software.

Preferably game play is animated on the screen from a graphics display engine forming part of the computer device.

Preferably the cashier is a software operated cashier.

Preferably player bets are placed through a bet input device connected to said computer.

In another example said bet input device is a player touch bet input device.

Preferably said bet input device is a keypad device.

Preferably said keypad device is a touch screen provided with a screen display for depicting bet options.

Preferably, the required number of identifiers is equal to the number of identifiers required to form a matrix.

Preferably, the identifiers are numbers.

Preferably a 3×3 matrix is used and the maximum number of identifiers is nine.

Preferably, the group of identifiers includes 80 unique identifiers.

Preferably, twenty identifiers are randomly and independently elected from the set of eighty identifiers to form the group.

In an alternative embodiment, a 4×4 matrix is used and the required number of identifiers is sixteen. In this case, the set of identifiers preferably includes forty identifiers and twenty identifiers are randomly elected from the set of identifiers to provide the group of identifiers.

In a further alternative, the required number of identifiers is twenty-five and these twenty-five identifiers are formed into a 5×5 matrix. In this case, the set of identifiers preferably comprises eighty identifiers and preferably forty identifiers are randomly elected to provide the group of identifiers.

According to a further aspect of the present invention there is provided a computer controlled hardware interconnected configuration for playing the above game, said configuration having:

1. a computer device programmed to carry out the game playing method,
2. an input means through which a player can elect an identifier,
3. a monitor screen on which identifiers chosen by the game controller can be displayed.

Preferably said configuration also includes a ticket issuing means for issuing a game play ticket with information concerning the obtained identifiers and the matrix.

Preferably said configuration includes a machine reading means for reading the information on said ticket following game play to identify a winning players ticket.

Preferably said configuration includes a pay-out terminal for paying out winnings read by said machine reading means.

BRIEF DESCRIPTION OF THE DRAWING(S)

In order that the invention can be more clearly ascertained, examples of preferred embodiments will now be described with reference to the accompanying drawings wherein.

DESCRIPTION OF THE PREFERRED EMBODIMENT(S)

Figure 1:
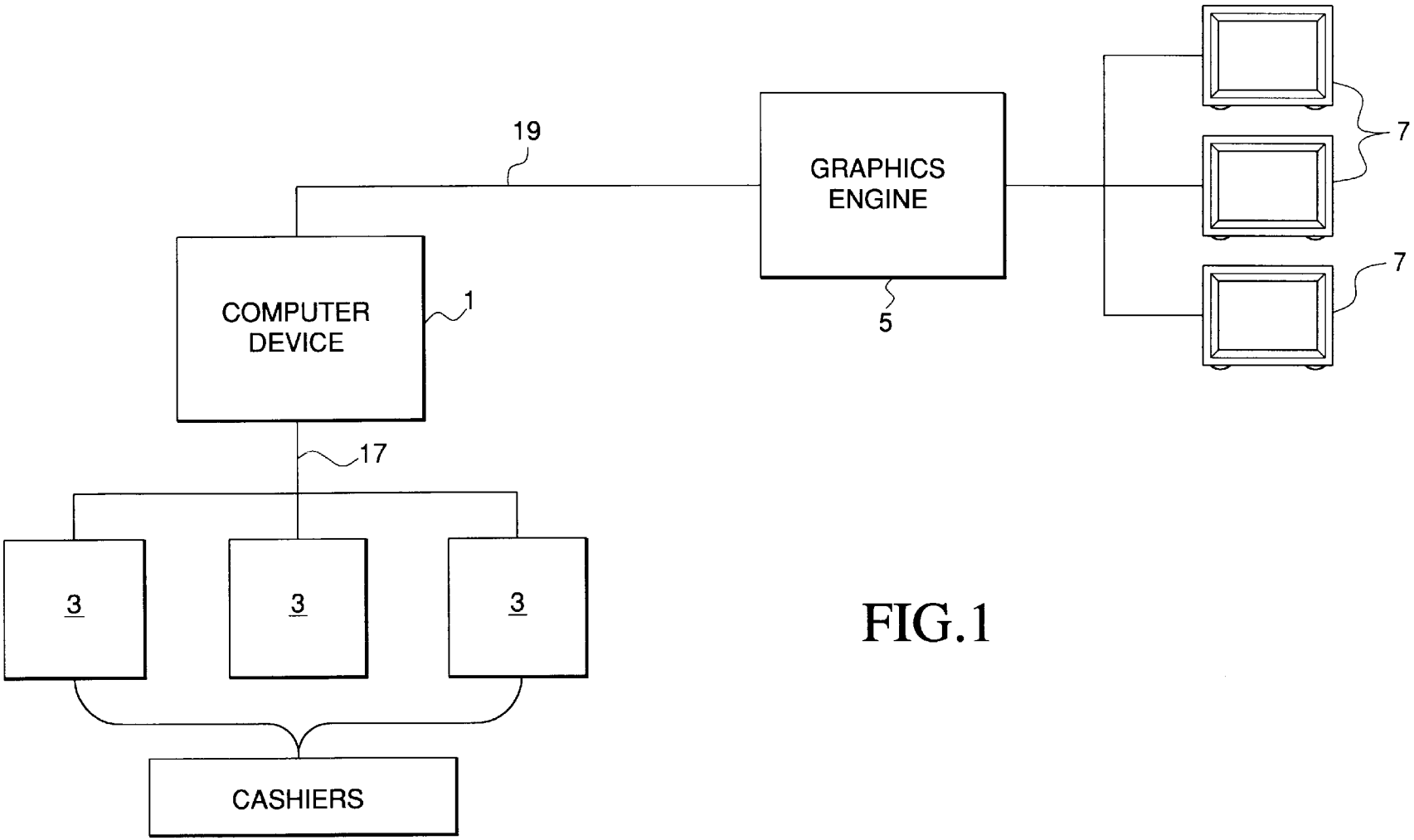
FIG. 1 is a block circuit schematic diagram of a simple configuration.

Referring firstly to FIG. 1 it can be seen that the game in this example is implemented in a configuration which includes a computer device. The game could be played by randomly electing identifiers in the form of numbers on tokens such as balls from a container holding the balls such as a barrel and other alternatives are not to be excluded from the broad inventive concept. The rules of the game will be described in due course. In other examples the game may be played on a machine like a gaming machine or it may be played on the Internet.

FIG. 1 shows that there is provided a computer device 1 which is interconnected with cashiers 3. The cashiers 3 are shown as a plurality with any desired number being possible. It is even possible to have a single cashier without falling outside the scope of the invention. The cashier 3 represents an input/output facility for game play where a player can participate in the game such as by placing a bet and wherein a pay-out can be made following game play as a prize for winning. The cashiers 3 provide data to the computer device 1 concerning the bets made. The computer device 1 is, in turn, connected with a graphics engine 5 which is used for displaying on one or more monitor screens 7, particular graphics relating to the game play. A suitable software program is provided within the computer device 1 to control game play and process cashier information. The graphic engine 5 is used to generate the particular image viewed on the monitor screen 7 in response to signals generated from the computer device 1. Thus, after players make bets, the computer device 1 signals the graphic engine 5 to commence a display on the monitor screen 7 relating to game play. All players then view the monitor screens to watch game play. If the players believe they have won at game play they can return to the cashiers 3 to obtain verification and collect a pay-out in that event.

Typically a player pays money on placing of a bet and therefore the prize is calculated against bets for money made, by all players and the number of matrix lines corresponding to the group of identifiers chosen by the game controller from the set of identifiers. The prize is preferably based on fixed odds but in another example it may be calculated based on the total number of players and the bets made by all players for a particular game. Software can be implemented to ensure there is always a return to the game controller or the house.

In a first example of a preferred embodiment of the invention where the set of real numbers one to eighty is used as the set of identifiers. The player is required to elect at least one number from this set of numbers up to a maximum number of identifiers which in this embodiment is nine numbers. If the player elects less than nine numbers, the computer device 1 which is a game controller, elects further numbers from the set of numbers to make up the required number of numbers. Once the required number of identifiers has been obtained by the combined actions of the player and the game controller the numbers are formed into a 3×3 matrix. The matrix defines a number of matrix lines with each column, row and diagonal forming a matrix line of identifiers. This is further illustrated in FIG. 8 where.it can be seen that there is a diagonal line 80*a* through numbers 61, 65 and 69, a row line 80*f* passing through numbers 61, 62 and 63 and a column line 80*c* passing through numbers 61, 64 and 67. There are further row, column and diagonal lines namely lines 80*b*, 80*d*, 80*e*, 80*g*, and 80*h* forming a total number of eight matrix lines for a 3×3 matrix.

Once the obtained numbers have been formed into the matrix, the game controller randomly elects a group of numbers from the set of numbers which is typically twenty numbers and these numbers are compared against the matrix of numbers to determine whether one or more matrix lines are completed i.e.—there are identifiers of the group of identifiers at each intersections along a matrix line or lines. Prizes are then awarded depending on the number of lines completed.

In a 3×3 matrix game there are a maximum of eight matrix lines. However, it will be noted that it is not possible to only have seven lines completed as each number in the matrix of numbers has a least two matrix lines passing through it. It is generally desirable that the pay outs be commensurate with the probability of various numbers of matrix lines being completed. Therefore, they prize will be relatively low when the players ticket includes one matrix line but much higher if the player gets six or even eight matrix lines with identifiers of the group of identifiers at each intersections along matrix lines.

Table 1 shows the probability and pay out calculation for a game employing a 3×3 matrix, where the game controller elects a group of twenty identifiers from a set of eighty identifiers.

TABLE 1

Beno 3 × 3 Matrix Probability and Payout Calculation

| | Probability | True Odds | Payout | House % |
|---|---|---|---|---|
| Probability 0 Lines | 0.90152731 | 0.109228743 | | |
| Probability 1 Lines | 0.08793380 | 10.37219156 | $2.00 | |
| Probability 2 Lines | 0.00889020 | 111.4833712 | $10.00 | |
| Probability 3 Lines | 0.00138528 | 720.8763337 | $100.00 | |
| Probability 4 Lines | 0.00020085 | 4977.901362 | $500.00 | |
| Probability 5 Lines | 0.00004736 | 21115.39931 | $1,000.00 | |
| Probability 6 Lines | 0.00001449 | 69033.38235 | $10,000.00 | |
| Probability 8 Lines | 0.00000072 | 1380686.647 | $100,000.00 | 23.16% |

In a variant to the above schedule an accumulating jackpot replaces the payout for eight lines. Typically once the jackpot has been paid out a new jackpot is selected so that a player will receive a satisfactory payment if he or she gets eight matrix lines. A table showing such a payout schedule where approximately 30% of the value of each ticket is added to the jackpot is set out below in Table 2:

TABLE 2

Beno 3 × 3 Matrix Probability and Payout Calculation

| | Probability | True Odds | Payout | House % |
|---|---|---|---|---|
| Probability 0 Lines | 0.90152731 | 0.109228743 | | |
| Probability 1 Lines | 0.08793380 | 10.37219156 | $2.00 | |
| Probability 2 Lines | 0.00889020 | 111.4833712 | $10.00 | |
| Probability 3 Lines | 0.00138528 | 720.8763337 | $50.00 | |

TABLE 2-continued

Beno 3 × 3 Matrix Probability and Payout Calculation

| | Probability | True Odds | Payout | House % |
|---|---|---|---|---|
| Probability 4 Lines | 0.00020085 | 4977.901362 | $200.00 | |
| Probability 5 Lines | 0.00004736 | 21115.39931 | $500.00 | |
| Probability 6 Lines | 0.00001449 | 69033.38235 | $5,000.00 | 52.97% |
| Probability 8 Lines | 0.00000072 | 1380686.647 | Jackpot | |

In an alternative game, a group of twenty identifiers can be drawn from a set of sixty numbers. A probability and payout schedule for such an embodiment is set out below in Table 3:

TABLE 3

Beno 3 × 3 Matrix Probability and Payout Calculation

| | Probability | True Odds | Payout | House % |
|---|---|---|---|---|
| Probability 0 Lines | 0.78537865 | 0.27327118 | | |
| Probability 1 Lines | 0.17432396 | 4.736446216 | $1.00 | |
| Probability 2 Lines | 0.03137530 | 30.87220499 | $5.00 | |
| Probability 3 Lines | 0.00697926 | 142.2816211 | $10.00 | |
| Probability 4 Lines | 0.00140126 | 712.6420509 | $60.00 | |
| Probability 5 Lines | 0.00037872 | 2639.475588 | $400.00 | |
| Probability 6 Lines | 0.00015149 | 6600.188971 | $1,000.00 | |
| Probability 8 Lines | 0.00001136 | 88014.85294 | $10,000.00 | 9.83% |

As with the twenty out of eighty game, the payout can be changed to incorporate a Jackpot on all eight lines. Table 4 is an example of a payout table with a sixteen number matrix using a twenty out of forty draw. In this instance it has a Jackpot on the cover all.

In this embodiment, the game controller typically independently and randomly elects twenty identifiers (numbers) from the set of identifiers to form a group of identifiers which are compared against a matrix of sixteen identifiers. Set out below is an example of a payout table for such an embodiment wherein the payout table includes a jackpot for the selection of ten lines. Similarly to the case of the 3×3 matrix it is not possible to get only nine lines.

TABLE 4

Beno 4 × 4 Matrix Probability and Payout Calculation

| | Probability | True Odds | Payout | House % |
|---|---|---|---|---|
| Probability 0 Lines | 0.595751954706 | 0.678550934 | | |
| Probability 1 Lines | 0.302050428636 | 2.310705449 | $0.00 | |
| Probability 2 Lines | 0.082503163260 | 11.12074738 | $1.00 | |
| Probability 3 Lines | 0.0163808103071 | 60.31921019 | $5.00 | |
| Probability 4 Lines | 0.002877158717 | 346.5651149 | $10.00 | |
| Probability 5 Lines | 0.000414838680 | 2409.575603 | $100.00 | |

TABLE 4-continued

Beno 4 × 4 Matrix Probability and Payout Calculation

| | Probability | True Odds | Payout | House % |
|---|---|---|---|---|
| Probability 6 Lines | 0.000081531005 | 12264.27261 | $1,000.00 | |
| Probability 7 Lines | 0.000010278097 | 97293.275 | $5,000.00 | |
| Probability 8 Lines | 0.000002466743 | 405391.8125 | $20,000.00 | |
| Probability 10 Lines | 0.000000077086 | 12972569 | Jackpot | 58.34% |

The foregoing payout table can be modified to incorporate a further feature such as a payout if a particular "lucky" identifier is among the group of identifiers or, for example a consolation prize may be paid if the matrix of identifiers does not include any of the elected group of identifiers.

In an alternative embodiment, the player elects from one to sixteen identifiers from a set of forty-five or fifty identifiers. Again if less than sixteen identifiers are chosen by the player, the game controller randomly elects further identifiers to make the number of identifiers up to the required number of sixteen identifiers.

In a further example for which a payout table is shown in Table 5, the rules of the game may be modified so that a 4×4 matrix is used and twenty-two identifiers are randomly elected to form the group of identifiers from a set of forty-five identifiers. This embodiment allows the present game to be played in conjunction with standard lotto games which draw six or eight numbers (identifiers) from a total of forty-five numbers. Additional numbers can be drawn from the set of numbers to make up the group of numbers needed to carry out the present game.

TABLE 5

Beno 4 x 4 Matrix Probability and Payout Calculation

| | Probability | True Odds | Payout | House % |
|---|---|---|---|---|
| Probability 0 Lines | 0.622546014358 | 0.606306967 | | |
| Probability 1 Lines | 0.285470809499 | 2.502985127 | $0.00 | |
| Probability 2 Lines | 0.074234028057 | 12.4709112 | $1.00 | |
| Probability 3 Lines | 0.14597684544 | 67.50401493 | $5.00 | |
| Probability 4 Lines | 0.002648997780 | 376.5012601 | $10.00 | |
| Probability 5 Lines | 0.000404534225 | 2470.978729 | $100.00 | |
| Probability 6 Lines | 0.000083409119 | 11988.09684 | $1,000.00 | |
| Probability 7 Lines | 0.000011373971 | 87919.04348 | $10,000.00 | |
| Probability 8 Lines | 0.0000003033059 | 329699.163 | $50,000.00 | |
| Probabitity 10 Lines | 0.000000115388 | 8666403.286 | 1,000,000.00 | 32.16% |

It is to be appreciated that the rules of the present game may be modified so that it can be run in conjunction with any other game which involves the random election of a group of identifiers from a set of identifiers. That is to say, the present game can use the same set of identifiers as another game so that the two games can be played at the same time. Such a method may involve the game controller of the present game electing additional identifiers from the set of identifiers elected in the other game or may employ the same group of identifiers as elected in the other game. For example in the twenty out of eighty model described above in relation to the 3×3 matrix game there is already an existing game named KENO which employs a twenty out of eighty number draw.

As stated previously the game need not be played with numbers but can be played with any set of identifiers. For example, the set of identifiers could be a pack of cards and a group of identifiers could be selected from the pack.

Figure 2:
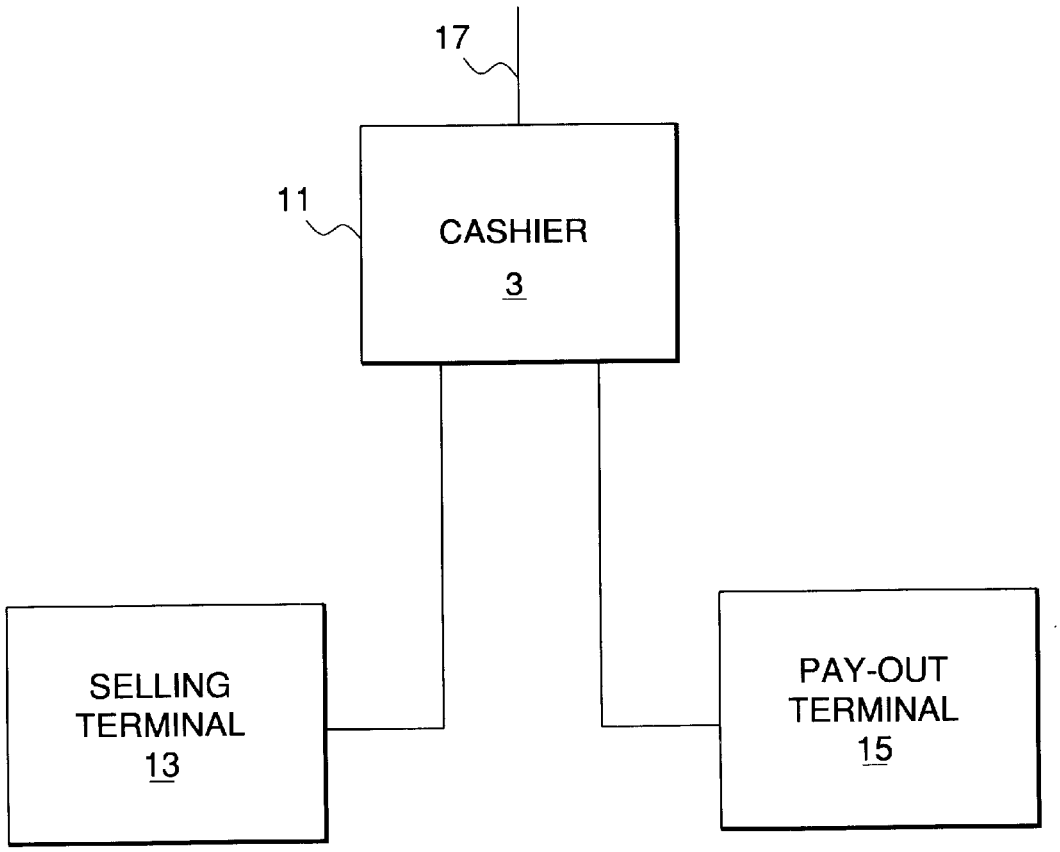
FIG. 2 is a block schematic diagram depicting an arrangement at a cashier terminal.

Referring now to FIG. 2 it can be seen that the cashiers 3 operate at a cashier station 11 which includes a selling terminal 13 and a pay-out terminal 15. The actual selling terminal 13 and pay-out terminal 15 may be the same terminal. It may also be merely a person at a cashier station 11. The selling terminal 13 can however, be a separate terminal to the pay-out terminal 15. The cashier station 11 can additionally provide some miscellaneous customer functions such as operator sign-on, operator sign-off, terminal balances and the like. The cashier station 11 may be a manned betting terminal, a self-service betting terminal, or a mobile terminal or the like. The basic operation of each terminal 11 is independent of the terminal type. The terminal 11 is a programmed device that communicates with the computer device 1 via a communication line 17 or by a bus connection in a gaming machine or via the Internet in an Internet implementation. The actual programme for the terminal 11 is either permanently stored in ROM at the terminal or down-loaded from the computer device 1 but in a gaming machine or in an Internet implementation the program can be appropriately provided. Variable data such as currency symbols, the set of identifiers and, unit cost for playing may be down-loaded into the terminal 11 from the computer device 1 each time the terminal 11 starts up.

Terminal software drives the operator interfaces, gathers operator inputs, sends data representative thereof to the computer device 1 for validation and processing. It also permits receiving a computer device 1 reply and displays the result, and permits a receipt means to be provided. In one preferred example this receipt means can be a ticket which is automatically printed, or it can be a ticket which is manually prepared. In another example the receipt means may be displayed on a screen if the game is played on a gaming machine or on the Internet. In another possibility it may be stored on some convenient medium such as a memory means and could include a smartcard. The receipt means is the player's receipt for game play. While the terminal 11 carries out some validation of inputs, all transactions which update the system are sent to the computer device 1 where they are fully validated independent of any terminal validation, and processed and recorded before a terminal reply is generated from the computer device 1. Terminal 11 reacts to the computer device 1 reply and displays an error if the transaction contains an error, or displays the bet and prints the ticket if the transaction is valid. The terminal is therefore preferably totally subservient to the computer device 1 and can only generate output based on information received from the computer device 1. Desirably emphasis is placed on accountability and every transaction needs to be received and recorded in the computer device 1 before a validation reply is sent back to the terminal 11 before it is seen either by an operator of the terminal or the game player.

The monitor screen 7 display an animation of the draw or selection of the identifiers—numbers—and the monitor screen 7 permits this display to be viewed by the player(s) and also permits audible sounds to be presented, as generated from the graphics engine 5.

The graphics engine 5 generates the graphic displays and sounds for the game including the draw animation as well as a subsequent display of the result, all in response to instructions received from the computer device 1. The graphics engine 5 is programmed to receive signals from a communications line 19 connected with the computer device 1. The graphics engine 5 also includes a storage medium which contains the necessary programmes and databases needed to generate full multi-media animation and other graphics displays. This can include a number of different scenarios that make the draw sequence different.

Each complete game sequence consists of a number of stages to sustain player interest and desirably includes results analysis of previous games played, most common and least common identifiers chosen, and jackpot information. It may also include various forms of promotions and advertising. The order of these stages is typically fixed and the duration of each stage is set by instruction from the computer device 1. Some stages may cycle automatically without any input from the computer device 1 while other stages are implemented in response to game play instruction from the computer device 1.

In an Internet implementation the screen is part of a PC configuration and the graphics engine programme resides in the PC.

At the beginning of each new game, information pertaining to the next game is sent to the graphics engine 5 from the computer device 1 and superimposed on the graphics held by the graphics engine 5. When the computer device 1 is ready to commence draw for game play, it sends the graphic engine 5 a message which contains the scenario to be used and the group of identifiers—numbers—(as determined by a random number generator within the computer device 1 or alternatively by a manual draw). The graphics engine 5 then animates the draw using full multi-media representation to produce the group of identifiers—numbers—with the requested scenario determined from the computer device 1. Once the draw has been fully animated, and results displayed, the graphic engine 5 informs the computer device 1 so that pay-out can then commence.

In this case, the graphics engine 5 is subservient to the computer device 1 and carries out displays and draw animations according to instructions from the computer device 1.

The computer device 1 is under control of a suitable software programme and holds the system parameters, system databases, and other system details and controls necessary for operation of the total system. All of the components in the system are subservient to the computer device 1.

The computer device 1 contains the necessary programmes to run the system and the control files needed to control the system and the databases that hold the system data. As stated above, the results of game play for the draws can be generated by a random number generator or manually by a human operator or by a mechanical ball draw device as known in the art. In the case of draw by a human operator or by a mechanical ball drawer device, input can be provided to the computer device 1 to signal the particular identifiers drawn. In this way, the information can then be displayed on the monitor screen 7. Typically if a manual draw or a mechanical ball draw device is implemented then information concerning each drawn identifier can be manually input to the computer device 1.

In the case where a random number generator is utilised then this will be a separate procedure operating within the computer device 1 so that the random numbers generated are based on a suitable algorithm. The group of identifiers—numbers—are then generated from the random numbers selected. Alternatively a separate random number generator can be provided which inputs into the computer device 1.

Where a player elects fewer than the required number of identifiers the random number generator is employed to generate the remaining identifiers required to complete the maximum number of identifiers. A person skilled in the art will realise that the program for generating random numbers will have to take into account the fact that the player will have already elected at least one identifier from the set of identifiers. Thus, the number generator will need to be altered to elect identifiers from identifiers not elected by the player.

In a variation of the above system, and assuming that the game is played in a regional location such as a large city, a Master of Ceremonies may announce the game on local television or radio. The actual draw may be televised so that players can individually see the identifiers drawn. The draw may be manual or may be under control of the computer device 1 and the graphics engine 5 or by some other means. The Master of Ceremonies can be used in a manner similar to Keno and Tattslotto-type television games, and provide enhanced excitement to players. Identifiers manually drawn can be suitably inputted to cashiers for pay-outs to winning players.

Figure 3:
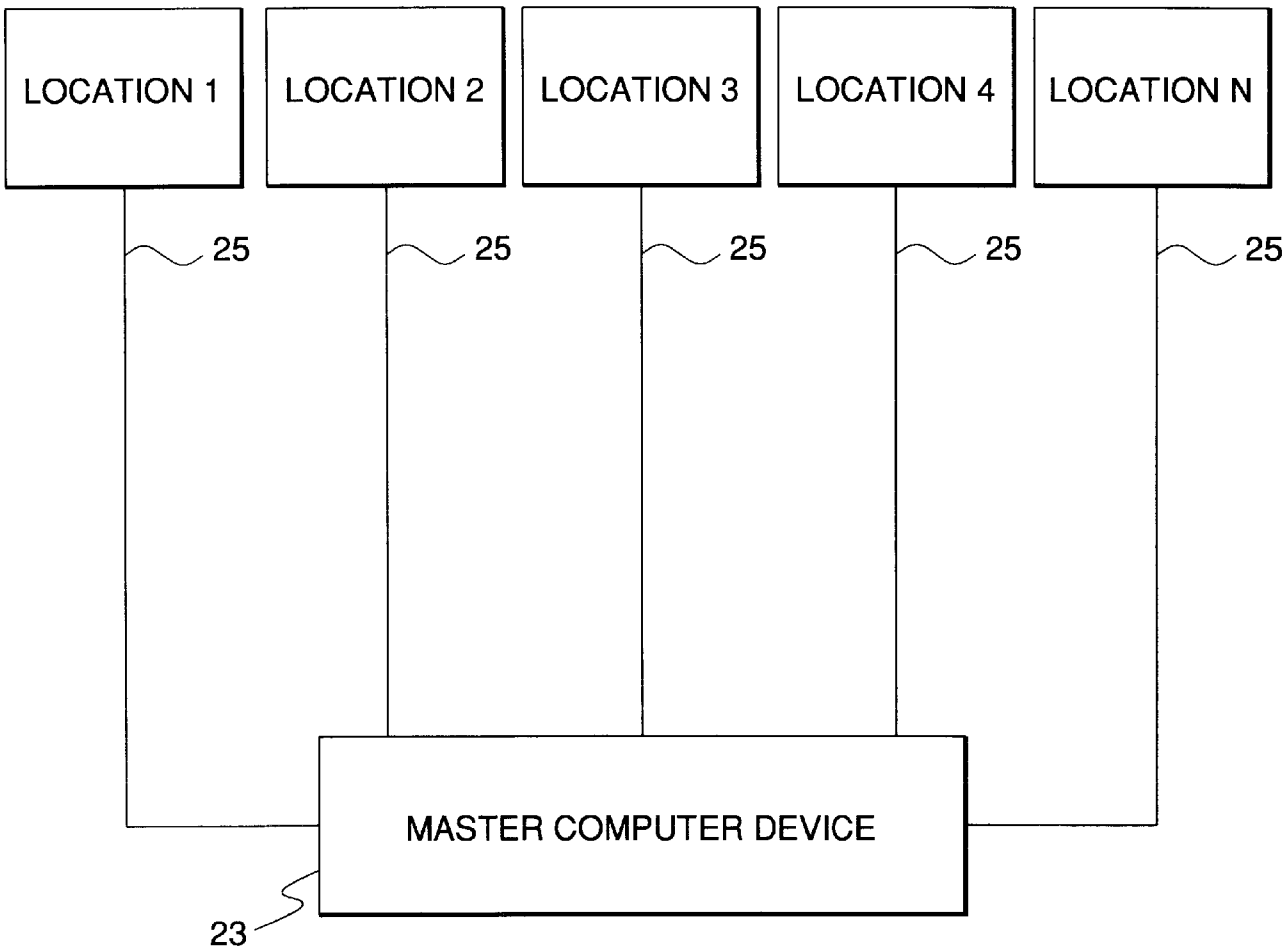
FIG. 3 is a block circuit diagram depicting a number of game playing locations interconnected with a master computer device.

FIG. 3 shows an environment where there are a number of discrete locations 1–N of cashiers, graphics engines, and monitor screens. In this configuration all locations are controlled from a master computer device 23. Each of the locations are connected via communication lines 25. Controlling software can be used to control game play concurrently at all locations.

Figure 4:
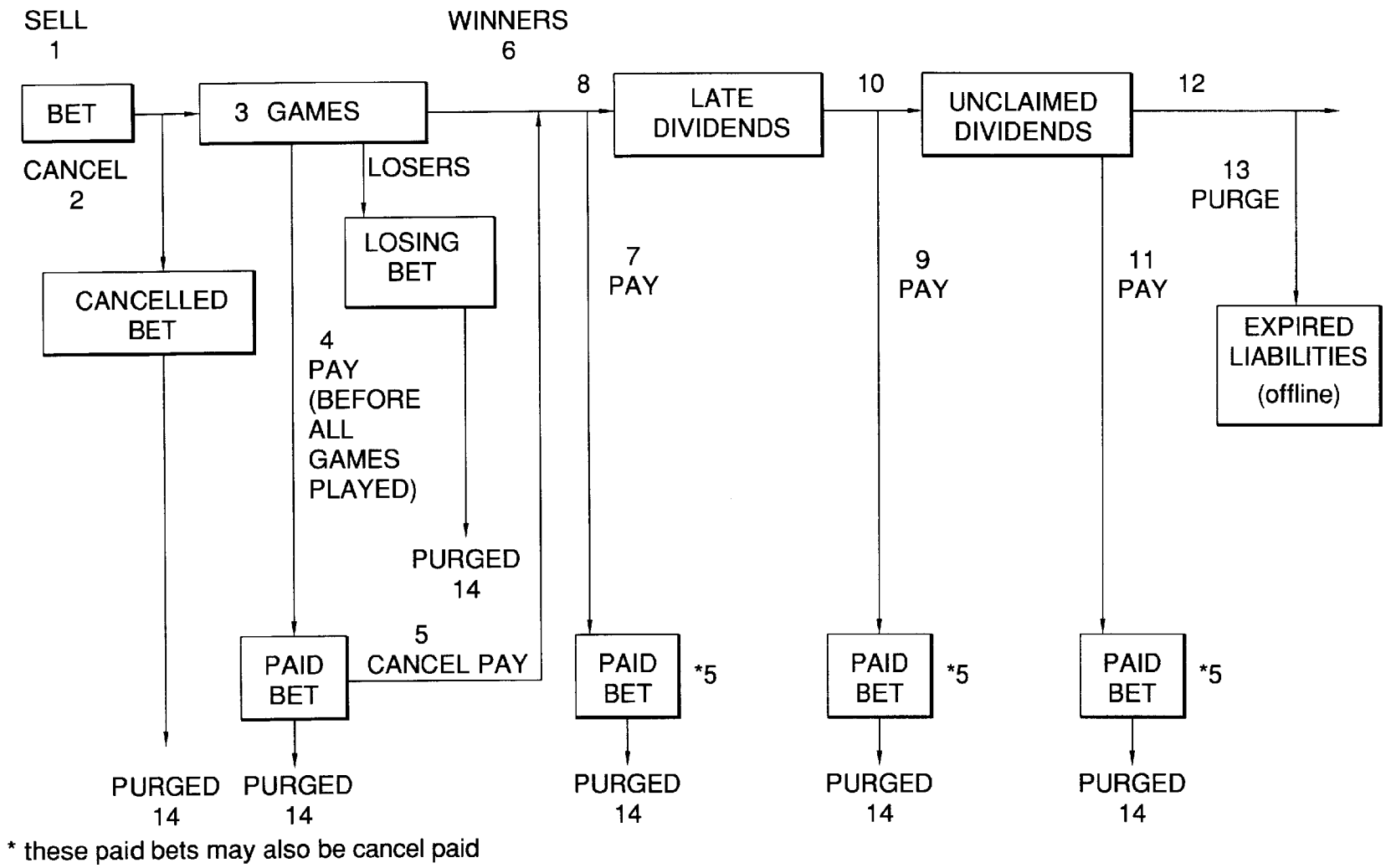
FIG. 4 is a functional flow diagram showing stages of game play and betting.

FIG. 4 is a diagram which shows the stages a bet which a game play can go through and are self-explanatory. It has the following steps.

1. The bet details are validated, and if valid, the bet value and a unique serial number are sent back to the terminal for printing of a ticket. The bet is then considered to be sold.
2. It may be cancelled before it can play any games.
3. Otherwise it starts to play its games.
4. A multi-game ticket may be paid before all its games are played.
5. A paid ticket may be 'cancel paid'. It DOES NOT PLAY ANY MORE GAMES and is treated like an unpaid winner. (It may be paid later).

-continued

| | |
|---|---|
| 6. | Otherwise bets play all the games for which they were bought. Bets receiving dividends are winners; the remaining bets are losers. |
| 7. | Winning bets may be paid. |
| 8. | Winning bets that remain unpaid after the period of the last game are called late dividends. Late dividends can be paid. |
| 9. | After a period of time unpaid late dividends become unclaimed dividends and the money resumed by the Government or Game Operator (depending on legislation in the jurisdiction in which the game is being operated). |
| 10. | Unclaimed dividends may be paid (and it is possible for this paid winning bet to be 'cancel paid' and paid again later). If an unclaimed winner is paid, the value is netted from that period's unclaimed dividend value. |
| 11. | Depending on the parameters that have been selected for the system, the unclaimed winner may continue in the system 'forever' (or until paid). |
| 12. | Else the unclaimed dividend will be purged (and reported) after the end of the period requested. |
| 13. | Cancelled bets, losing bets, paid bets are all purged from the system at the intervals that have been specified. |

For completeness, cancel pays (STEP 5) have been shown but cancel pays should be extremely rare, probably only occurring when a terminal operator has insufficient funds to pay a large winning bet.

Figure 5:
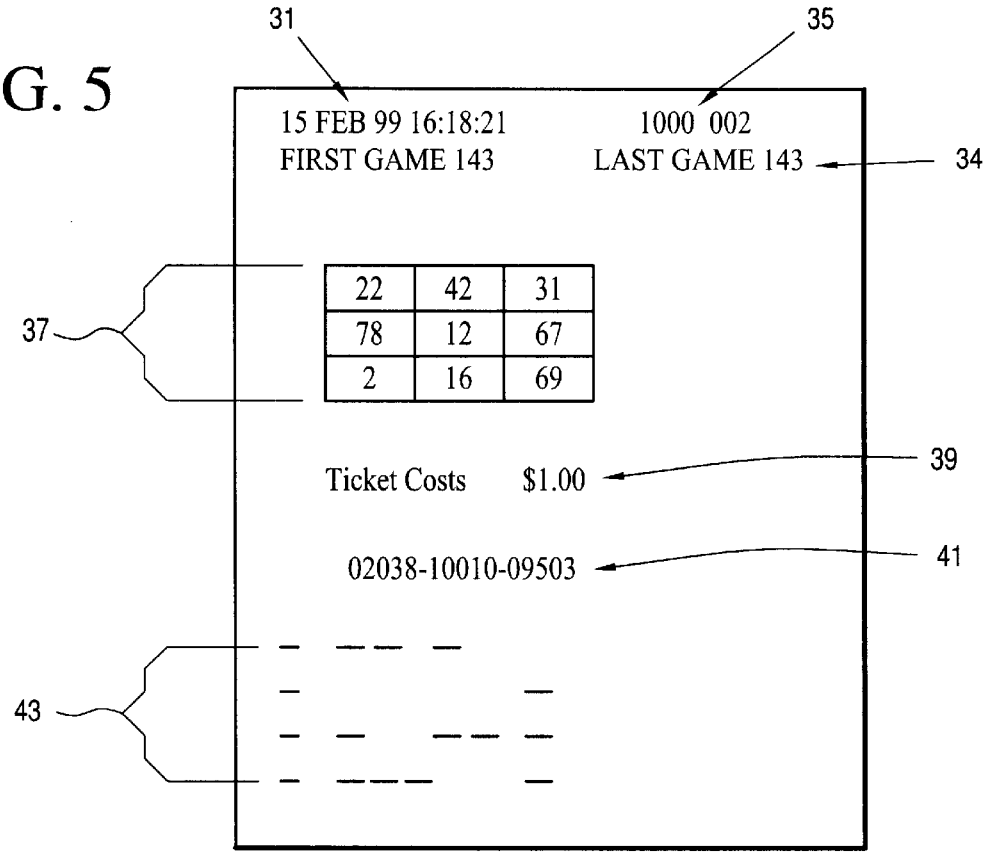
FIG. 5 is a representation of a ticket issued prior to game play in an example of the preferred embodiment which employs a 3×3 matrix.
Figure 6:
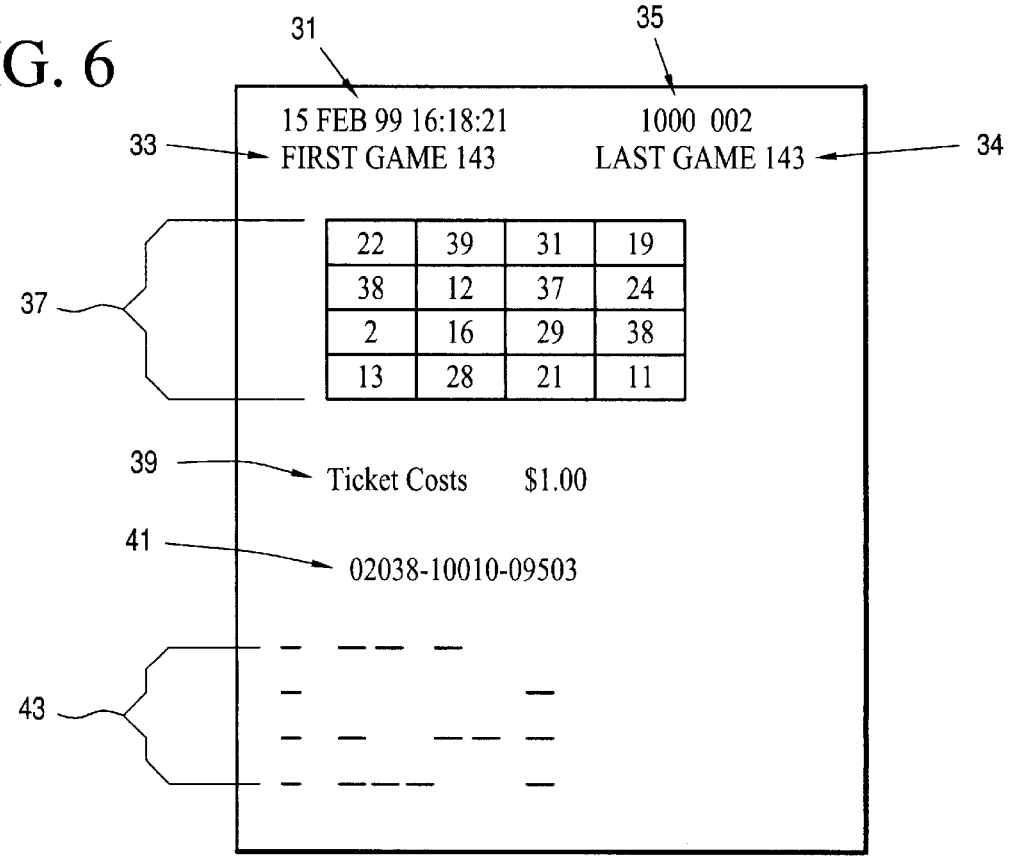
FIG. 6 shows a ticket issued prior to game play in an example of the preferred embodiment which employs a 4×4 matrix.
Figure 7:
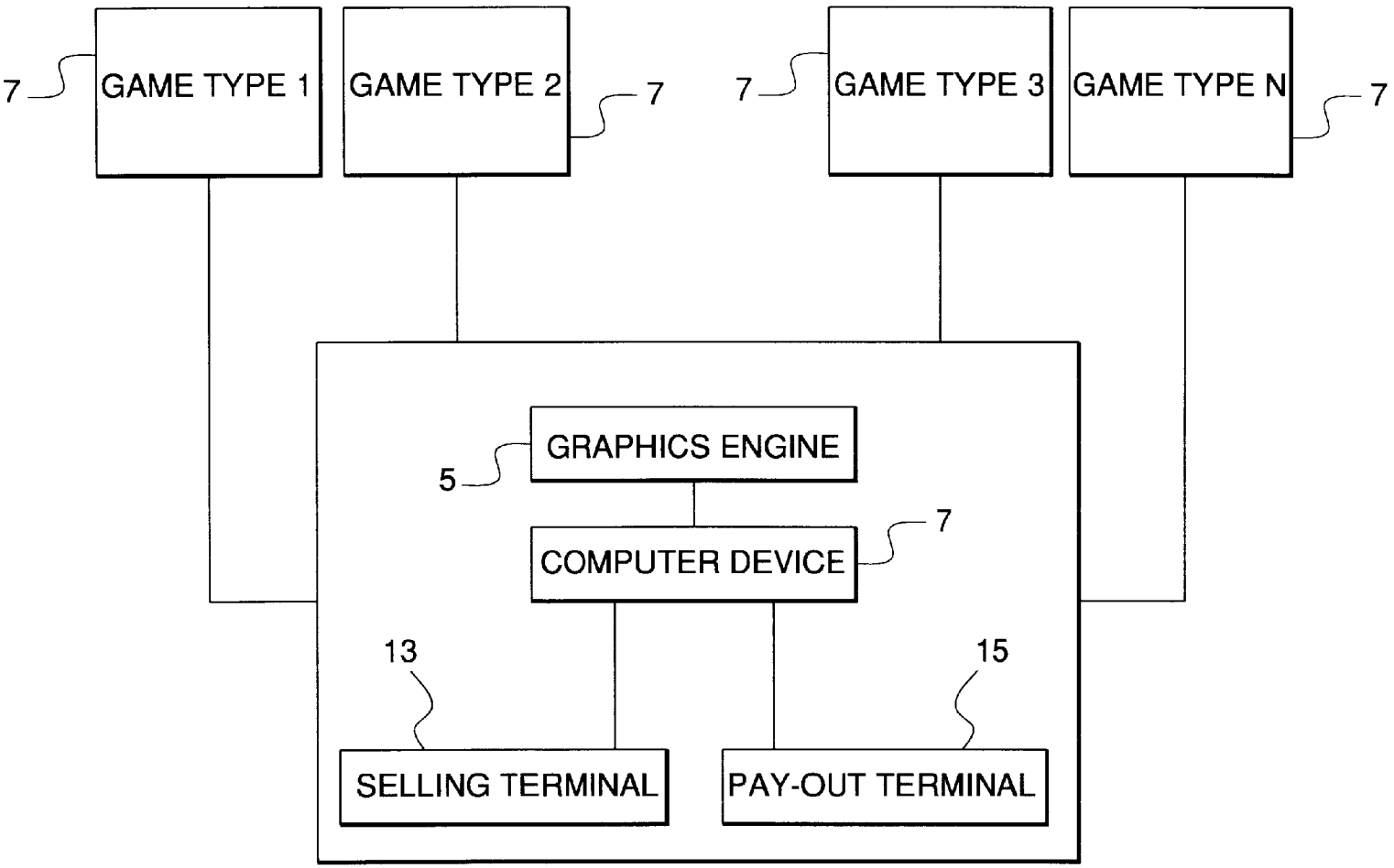
FIG. 7 is a block circuit schematic diagram representing a configuration where a plurality of different game types are played in the configuration.

FIG. 5 shows a typical receipt means in the form of a ticket which is issued to a person playing a game following the placing of a bet in a 3×3 matrix game. FIG. 6 shows a receipt means for a 4×4 matrix game. In both Figures like reference numerals are used to refer to the similar portions of the receipt means. It can be seen that it includes the date at the top region 31, the first game to be played at region 33, the last game to be played at region 34, the number and location of the terminal which issued the ticket at 35, and the particular identifiers obtained by the player and the game controller to provide the required number of identifiers formed into a matrix are shown at region 37. The monetary value paid for the ticket is shown in area 39. Area 41 shows the serial number of the ticket. Area 43 shows markings representative of the serial number of the ticket which can be read from the ticket by a machine reader device to facilitate processing of pay-outs. This provides a pointer that allows the software to locate the bet in memory of the computer. The exact arrangement of the code shown is immaterial and is merely representative of a typical arrangement. If multiple games are played this is represented by the first game number and the last game number in areas 33 and 34.

The tickets show one game by the fact the first game is shown as 143 and the last game is shown as 143. The ticket may be valid for a number of games, however, in the present example it is valid for a single game only.

Referring now to FIG. 6 it can be seen that there is a n arrangement whereby a plurality of different types of games can be played through the configuration shown in FIGS. 1 and 2. In this case there may be different monitor screens 7 for each game or alternatively all games may be played on a single monitor screen 7. Software will prevent different game types clashing during play of another game type. In this scenario, the graphics engine 5 will contain all the necessary software for each of the respective game types.

The monitor screens 7 and associated audio speakers or a Master of Ceremonies providing draw results through a television station or radio station for the like can announce a pre-draw game build-up. In this case the Master of Ceremonies may announce as follows "Ladies an d Gentlemen, this is your last chance to win "x" dollars on the next game which will be drawn in 20 seconds, time."

There can be music and fanfare and other displays to build player excitement. The Master of Ceremonies will then conduct the game play. This may involve a complicated mechanical ball machine which draws balls having numbers on them in an interesting manner.

During game play identifiers are elected from the set of identifiers with a voice-over announcing each identifier as it is drawn. The player then can compare the group of identifiers with the identifiers on their ticket to determine whether they have won. The ticket may then be fed to a reader means to verify whether the ticket is a winning ticket. Alternatively the player may feed their card directly to a reader means to determine whether they have won. In an electronic version of the game, the group of numbers may be compared with the players obtaining numbers as they are being drawn so as the draw progresses the player may see how they are progressing thereby building tension and excitement, particularly when the player is getting progressively closer to having a large number of matrix lines completed as the draw progresses. This may be done by highlighting the numbers in the matrix as they are drawn from the set of numbers and incorporating additional graphics to show when a matrix line has been completed.

The results of all randomly elected identifiers can then be displayed. The monitor screens 7 can then, if desired, slowly display back over the last games, such as the last sixteen through twenty game plays and show the most popular and least popular identifiers drawn.

In a variation, a progressive jackpot prize can be drawn as an accumulation jackpot after the playing of many games, as discussed previously.

In a further variation a plurality of different game types can be played which use the same set of identifiers, and wherein the progressive jackpot is for players of all game types and where a bet by a player triggers a progressive jackpot value from all bets made by all players for all games. The value of the progressive jackpot can be set in any convenient way such as manually or electronically and can therefore be a mystery progressive jackpot, particularly if it is randomly chosen.

In a further variation, and as an example FIG. 5 herein will be referred to, if the identifiers are cards or identifiers similar to cards, where there are suits, then if there is a correspondence of all the same identifiers from a suit along the complete matrix lines, then an additional prize, such as a jackpot prize can be awarded.

For example, in FIG. 5, if the identifiers along the top horizontal matrix line are corresponding to the identifiers elected by the game controller and all those identifiers are in the same suit then the additional prize can be obtained. Further, if the identifiers in a matrix line were all Aces, then an additional prize can be obtained.

Modifications may be made to the invention as would be apparent to a person skilled in the gaming and entertainment arts. These and other modifications may be made without departing from the ambit of the invention the scope of which is to be determined from the following claims.

What is claimed is:

1. A method of playing a game, the game being played by:

(a) a player obtaining from a set of identifiers, at least four identifiers, but no more than a required number of identifiers preset for a given game wherein each identifier of the set of identifiers must be different but the identifiers which may be obtained are otherwise unrestricted;

(b) forming a square matrix display from the player obtained identifiers, the square matrix defining a number of matrix lines of the matrix with each column, diagonal, and row of the matrix forming a matrix line of player obtained identifiers;

(c) a game controller randomly, and independently, electing a group of identifiers from said set of identifiers in such a manner that no identifier can be chosen twice, and wherein there are a predetermined number of identifiers in said group;

(d) comparing the group of identifiers and the matrix display to determine corresponding identifiers in the matrix display after the group of identifiers is elected;

(e) determining if there are corresponding identifiers for entire matrix lines, any such matrix line being a completed matrix line; and (f) the game controller awarding a prize to the player if the number of completed matrix lines is one or more, wherein the prize awarded is dependent on the number of completed matrix lines of the player's matrix display.

2. A method as claimed in claim 1, wherein the player elects at least one identifier and if the player elects fewer identifiers than said required number of identifiers, the game controller randomly elects further identifiers so that the required number of identifiers are obtained from said set of identifiers.

3. A method as claimed in claim 1, wherein the prizes awarded increases in accordance with the number of completed matrix lines up to a maximum prize corresponding to a maximum number of matrix lines which can be completed.

4. A method as claimed in claim 1, wherein the prize is calculated against bets for money made by the player and the number of completed matrix lines.

5. A method as claimed in claim 1, wherein a number of identical games are played, and a progressive jackpot prize is provided based on all the games played if the number of completed matrix lines equals the maximum number for a given matrix.

6. A method as claimed in claim 5, wherein the progressive jackpot prize is calculated from all the losing players bets from all those games of the number of games where no jackpot has been won.

7. A method as claimed in claim 1, wherein the player makes a monetary bet with a cashier when obtaining said identifier, and is provided with a game play receipt identifying the game, the obtained identifiers and the matrix display.

8. A method as claimed in claim 7, wherein the receipt is in the form of a ticket.

9. A method as claimed in claim 8, wherein the ticket is issued by a ticket selling terminal.

10. A method as claimed in claim 8, wherein at the end of game play, winnings are paid out by the player presenting the receipt to a pay-out cashier.

11. A method as claimed in claim 10, further including coding said ticket with information relating to the game to be played and on completion of play reading said code, and paying out winnings in accordance with said code.

12. A method as claimed in claim 11, wherein the coding is machine readable coding and a machine reader is used to read the code and a pay-out made from that reading by a pay-out terminal.

13. A method as claimed in claim 7, wherein the receipt also identifies the monetary bet made by the player.

14. A method as claimed in claim 7, wherein a player obtains a receipt by marking a mark sense card and supplying that card to a cashier.

15. A method as claimed in claim 14, further marking said card being read by a mark sensing card reader device.

16. A method as claimed in claim 14, wherein the cashier is a software operated cashier.

17. A method as claimed in claim 1, wherein a Master of Ceremonies is used during game play to announce the identifiers elected by the game controller to build excitement to game play.

18. A method as claimed in claim 1, wherein each of the identifiers elected by the game controller is displayed on a game monitor screen.

19. A method as claimed in claim 7, wherein game play is software controlled in a computer device to which a game monitor screen is connected, and said game controller is functionally controlled by the software.

20. A method as claimed in claim 19, wherein game play is animated on the screen from a graphics display engine forming part of the computer device.

21. A method as claimed in claim 19 wherein player bets are placed through a bet input device connected to said computer device.

22. A method as claimed in claim 21, wherein said bet input device is a keypad device.

23. A method as claimed in claim 22, wherein said key pad device is a touch screen provided with a screen display for depicting bet options.

24. A method as claimed in claim 1, wherein the player obtains the required number of identifiers by requesting the game controller to randomly elect the required number of identifiers.

25. A method as claimed in claim 1, wherein the identifiers are numbers.

26. A method as claimed in claim 1, wherein a 3×3 matrix is used and the required number of identifiers is nine.

27. A method as claimed in claim 26, wherein the group of identifiers consists of eighty unique identifiers.

28. A method as claimed in claim 27, wherein twenty identifiers are randomly and independently elected from the set of eighty identifiers to form the group.

29. A method as claimed in claim 1, wherein a 4×4 matrix is used and the required number of identifiers is sixteen.

30. A method as claimed in claim 29, wherein the set of identifiers consists of forty unique identifiers and twenty identifiers are randomly elected from the set of identifiers to provide the group of identifiers.

31. A method as claimed in claim 1, wherein the required number of identifiers is twenty-five and said twenty-five identifiers are formed into a 5×5 matrix.

32. A method as claimed in claim 31, wherein the set of identifiers consists of eighty unique identifiers and forty identifiers are randomly elected to provide the group of identifiers.

33. A computer controlled hardware interconnected configuration for playing the game as claimed in claim 1, said configuration having:

1. a computer device programmed to carry out the game playing method,
2. an input means through which a player can elect an identifier,
3. a monitor screen on which identifiers chosen by the game control can be displayed.

34. A configuration as claimed in claim 33, further including a ticket issuing means for issuing a game play ticket with information concerning the elected identifiers and the matrix.

35. A configuration as claimed in claim 33, further including a machine reading means for reading the information on said ticket following game play to identify a winning players ticket.

36. A configuration as claimed in claim 35, further including a pay-out terminal for paying out winnings read by said machine reading means.

* * * * *

UNITED STATES PATENT AND TRADEMARK OFFICE

CERTIFICATE OF CORRECTION

PATENT NO. : 6,666,767 B1
DATED : December 23, 2003
INVENTOR(S) : Marcel Dayan

It is certified that error appears in the above-identified patent and that said Letters Patent is hereby corrected as shown below:

Title page,
Item [73], Assignee, -- Structured Data Systems Pty Ltd., Melbourne VIC, Australia 3000 -- should be included.

Figure 8:
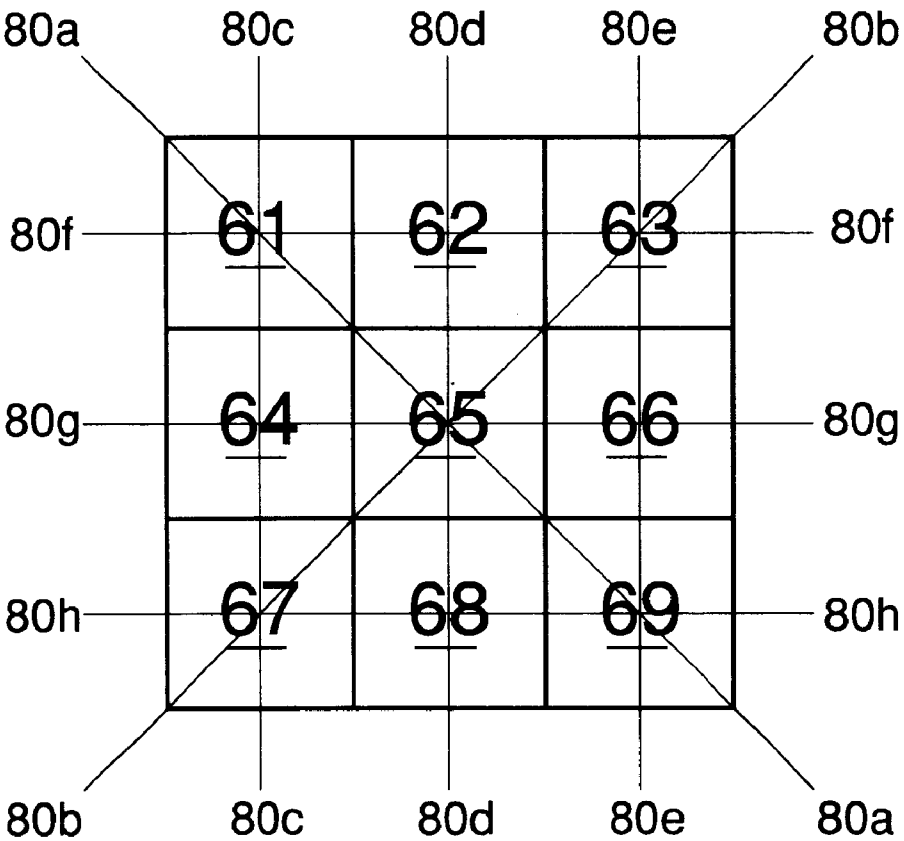

Column 3,
After line 53, the following should appear: -- FIG. 8 illustrates a sample 3x3 matrix of numbers formed for playing the game, according to a preferred embodiment of the present invention. --

Column 14,
Line 8, “claim 7” should be corrected to read -- claim 1 --.

Signed and Sealed this

Thirteenth Day of April, 2004

JON W. DUDAS
*Acting Director of the United States Patent and Trademark Office*